United States Patent [19]

Bertollo

[11] Patent Number: 4,938,461

[45] Date of Patent: Jul. 3, 1990

[54] DEVICE FOR DISTRIBUTING GAS INTO MOLTEN METAL

[75] Inventor: Daniele Bertollo, Milan, Italy

[73] Assignee: Zedmark Refractories Corp., Slippery Rock, Pa.

[21] Appl. No.: 360,604

[22] Filed: Jun. 2, 1989

[51] Int. Cl.[5] ..... C21C 5/48

[52] U.S. Cl. ..... 266/266; 266/270

[58] Field of Search ..... 266/220, 265, 266, 270

[56] References Cited

U.S. PATENT DOCUMENTS

| | | | |
|---|---|---|---|
| 4,535,975 | 8/1985 | Buhrmann et al. | 266/220 |
| 4,560,149 | 12/1985 | Hoffgen | 266/220 |
| 4,632,367 | 12/1986 | La Bate | 266/220 |
| 4,657,226 | 4/1987 | Illemann et al. | 266/220 |
| 4,741,515 | 5/1988 | Sharma et al. | 266/266 |

FOREIGN PATENT DOCUMENTS

| | | | |
|---|---|---|---|
| 292670 | 11/1988 | European Pat. Off. | 266/270 |
| 2189583 | 10/1987 | United Kingdom | 266/265 |
| 88-04330 | 6/1988 | World Int. Prop. O. | 266/266 |

*Primary Examiner*—Robert McDowell

*Attorney, Agent, or Firm*—George C. Atwell

[57] ABSTRACT

An impervious refractory plug clad in a metal canister, adapted for insertable registration in an opening in a refractory block of a ladle, is provided with an array of narrow peripheral passages formed in the plug's lateral surface to distribute a flow of inert gas into molten metal within the ladle. The passages are defined by slots preformed in the plug's peripheral surface and the inner surface of the tightly fitted canister. An elongated metallic strip is preferably located in each passage to induce solidification of any molten metal which tends to flow against the output ends of the passages.

19 Claims, 4 Drawing Sheets

DEVICE FOR DISTRIBUTING GAS INTO MOLTEN METAL

BACKGROUND OF THE INVENTION

This invention relates generally to apparatus for supplying inert gas through the wall of a metallurgical container, and more particularly pertains to an insertable and replaceable apparatus for discretely dividing a flow of inert gas into a plurality of streams whereby a dispersion of fine bubbles of the gas is injected into molten metal undergoing refinement in a ladle.

It is common practice in the metallurgical art to utilize injection plug devices to distribute inert gas into molten metal contained in a ladle. Typically, the ladle has a refractory block inwardly adjacent its bottom surface with a central opening in alignment with an opening in the ladle bottom to accommodate insertable registration of a gas injection plug. Such plugs are either permeable refractory elements which permit a gas flow to filter through the plug body or solid impervious refractory elements having an array of capillary passages extending through the plug body to conduct a series of discrete gas streams therethrough. U.S. Pat. No. 3,330,645 discloses both the foregoing concepts in one device, utilizing a porous plug material and also providing tubular passageways through the porous body.

Utilization of a solid impervious refractory plug with provision of a peripheral or annular gas flow passage, between the plug's outer surface and a surrounding metallic sleeve, has been found to have certain distinct advantages. A solid plug has much greater strength and erosion resistance as compared to a porous plug, and the maintenance of continuous open flow conditions is greatly improved. U.S. Pat. Nos. 4,396,179 and 4,538,795 disclose plug structures which utilize a solid refractory core within a surrounding shell spaced from the core's outer surface to provide a concentric gas passageway for delivering gas into the molten metal within a ladle, and the advantages of such structures are explained in these patents. A variation of the foregoing concept is found in U.S. Pat. No. 4,462,576 which teaches the provision of a fibrous permeable ceramic layer concentrically located between the outer surface of a frusto-conical solid refractory plug and a surrounding metal jacket.

Another rather recent development in the art has been the provision of a gas injection plug device wherein channels are preformed in the lateral surface of a solid refractory plug and a properly sized metallic sleeve or canister is positioned about the plug in a heated condition and allowed to cool and shrink tightly to the plug body, thereby closing over the plug surface channels to form an array of gas distribution passages. Provision of the longitudinally-extending slots in the lateral surface of the plug and shrinking the metallic sleeve tightly onto the plug body assures a unitized structure, however, there has been a problem in the formation of such devices and maintaining a smooth symmetrical exterior configuration because of the tendency of the thin-walled metal shell to deform inwardly toward the plug slots and thus create a wavy and uneven shell outer surface which will not register smoothly and contiguously within the opening or socket provided in the refractory block of the ladle. Moreover, blockage of the outlet ends of the passages by molten metal, although less of a problem than with permeable or porous plug bodies, nevertheless, continues to invite resolution.

SUMMARY OF THE INVENTION

The present invention comprehends the provision of a device for supplying inert gas, through the wall of a metallurgical container, which includes a plug of impervious refractory material closely fitted within, and extending substantially the full length of, a sleeve or shell, preferably in the form of a stainless steel canister. The device further includes a means for conducting a gas flow from the canister's closed end and out through the outlet end, including a plurality of spaced-apart passages or channels. Each of the passages is a slot in the plug's lateral surface and is partially defined along its full length by the inside surface of the canister.

The plug preferably has the form of a truncated cone with a base end adjacent the closed end of the canister and a comparatively narrow face end adjacent the open end of the canister. The slots in the lateral surface of the plug which contribute to formation of the passages, run longitudinally, from a space or manifold chamber provided between the base end of the plug and the closed end of the canister, to the face end of the plug.

The slots in the plug's lateral surface are identical in configuration to each other and each is preferably rectilinear in cross-section with a depth co-extensive with the radius of the plug and preferably about fifteen times greater than the extremely narrow slot width.

An elongated metallic silver or strip, preferably of stainless steel, is preferably disposed in each of the passages. Each strip has a flat planar body portion of uniform width and thickness, the width being substantially equal to the slot depth and the thickness preferably being about one-half the slot width. One end of the strip is angled to present an end tab portion which projects into the space between the closed end of the canister and the base end of the plug. The strips contained in the passages as heretofore described constitute heat sink elements which act to solidify any molten metal tending to flow into the outlet ends of the passages when gas flow is shut off.

Structural characteristics of the device of the present invention and its operational features and advantages will become apparent from the ensuing detailed description, particularly when read in reference to the various figures of the accompanying drawings which illustrate the preferred embodiment of the device.

DETAILED DESCRIPTION OF THE PREFERRED EMBODIMENT

Figure 1:
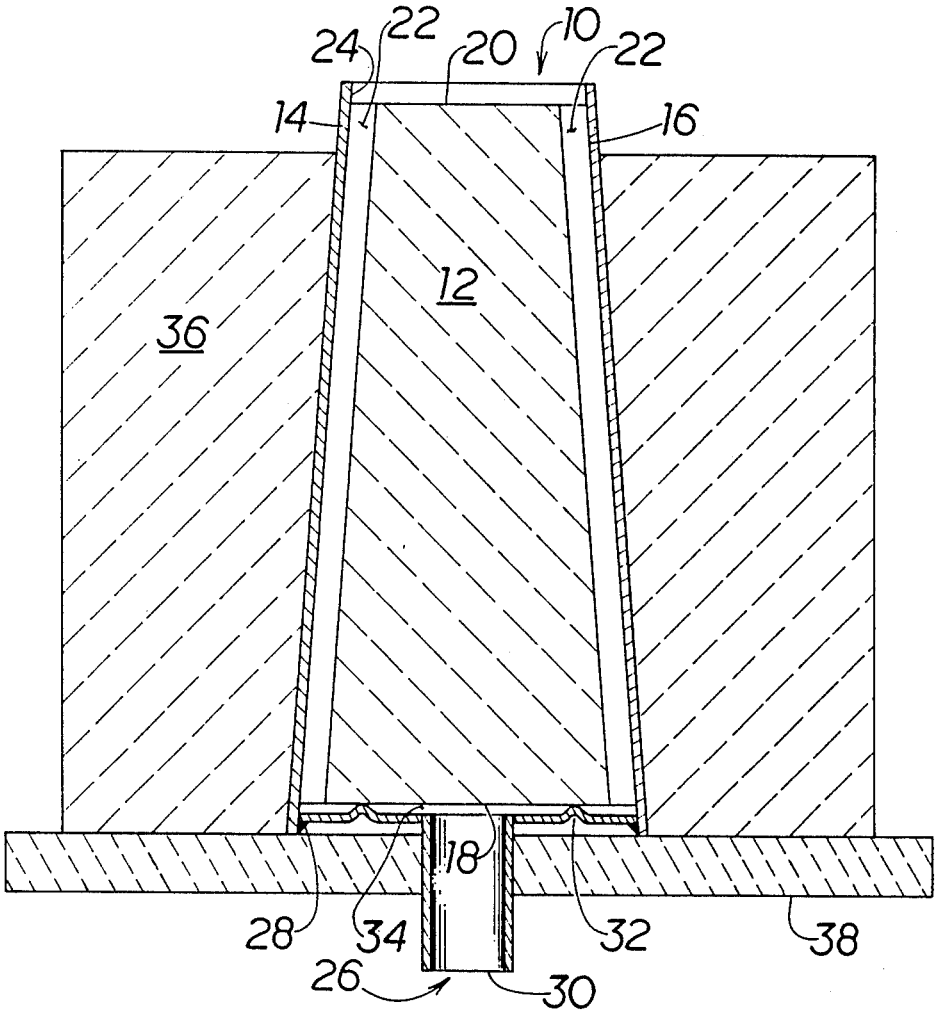
FIG. 1 is a view in vertical cross-section of the preferred embodiment of the present invention.
Figure 6:
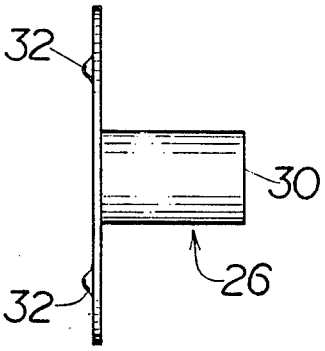
FIG. 6 is an elevational view taken from the left side of FIG. 5.
Figure 5:
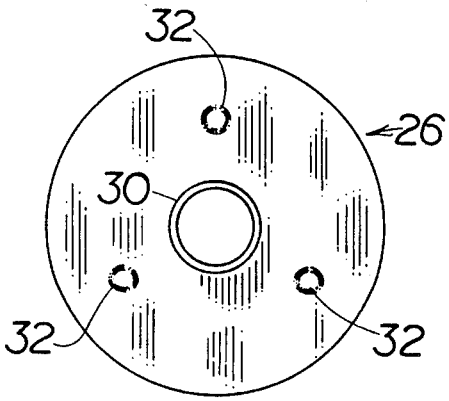
FIG. 5 is a bottom plan view of one component of the device first shown in FIG. 1.
Figure 3:
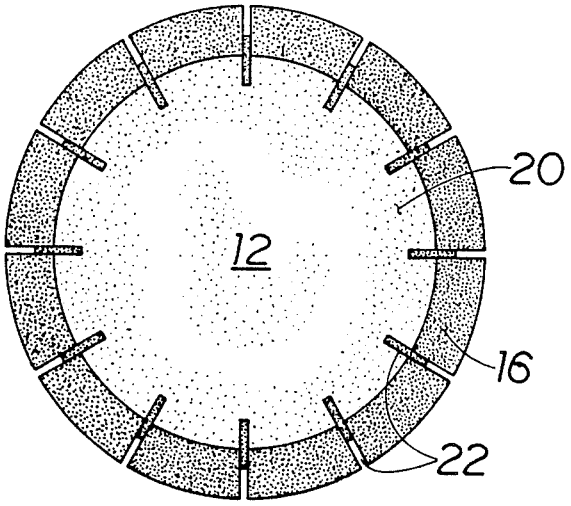
FIG. 3 is a top plan view of the plug component shown in FIG. 2.
Figure 2:
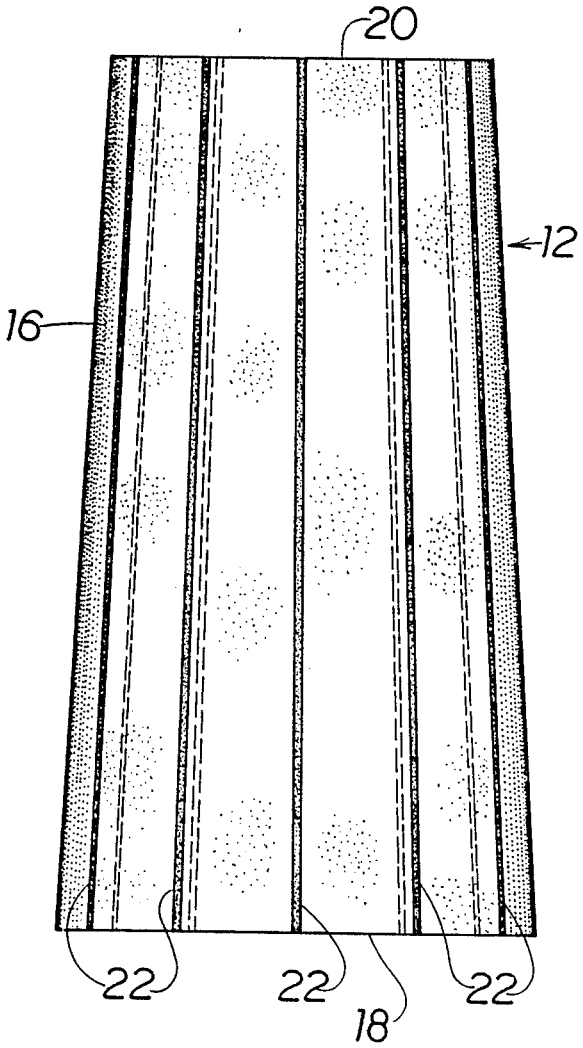
FIG. 2 is a side elevational view of a refractory plug which constitutes a major component of the preferred structure of the present invention shown in FIG. 1.

The structure of the preferred embodiment of the present invention is illustrated in FIG. 1 which shows a device 10 for supplying gas through the wall of a metallurgical container. The device 10 includes a solid impervious refractory plug 12 contained within a sleeve or canister 14. The exterior of the plug 12, shown in FIGS. 2, 3, and 4, includes a lateral or side surface 16, a base end 18, and an opposite face end 20. Extending into the lateral surface 16 of the plug 12 is a plurality of equidistantly spaced longitudinal slots 22.

The sleeve 14 is preferably formed from stainless steel and has an open outlet end 24 and an opposite disc-shaped closure member 26. The closure member 26 is formed from mild steel and is provided with a central outwardly-projecting gas inlet nipple 30. The closure member 26 is further provided with a series of upwardly-directed dimples 32 which maintain the base end 18 of the plug 12 in spaced relation to the plug base end 18, thereby defining a manifold area 34 across the full expanse of the base end 18 and in flow communication with the plurality of slots 22.

A specific feature of the present invention is the provision and particular configuration of the slots 22 in the plug 12. The slots 22 are identical to each other and each extends from the face end 20 to the base end 18 of the plug 12. Each slot 22 is preferably coextensive with a radius of the plug 12 and has a very narrow width, denoted as "W" in FIG. 4, with the depth, being the dimension taken coextensive on the radius of the plug 12, denoted as "D" in FIG. 4, being at least ten times greater than the width.

In practice, the sleeve 14 is designed to fit like a gripping skin about the lateral surface of the plug 12. Assembly of the device 10, as shown in FIG. 1, involves heating the sleeve or canister 14, prior to the installation of the closure member 34 to expand the sleeve whereby it can be slipped over the refractory plug 12 and allowed to cool and shrink tightly on the plug. The installation of the sleeve on the plug closes off the outer open elongated edges of the slots 22, thereby completing the definition of longitudinal gas distribution channels or passages.

Following the fixed attachment of the closure member 34 to the disposition shown in FIG. 1, the device 10 can be insertably registered within the central opening or socket of a refractory block 36 provided inwardly adjacent the wall of a metal refining ladle. An outer support block 38, or similar means, may be used to retain the device 10 in its operational position.

In the refining of metal in a ladle wherein the device 10 is utilized, a flow of inert gas is introduced through the bore of the nipple 30. The gas flow disperses radially outwardly through the manifold area 34 and then upward through the discrete passages or channels 22 and is ejected into the molten metal within the ladle from the face end of the plug 12 to thereby stir and agitate the molten metal.

Figure 7:
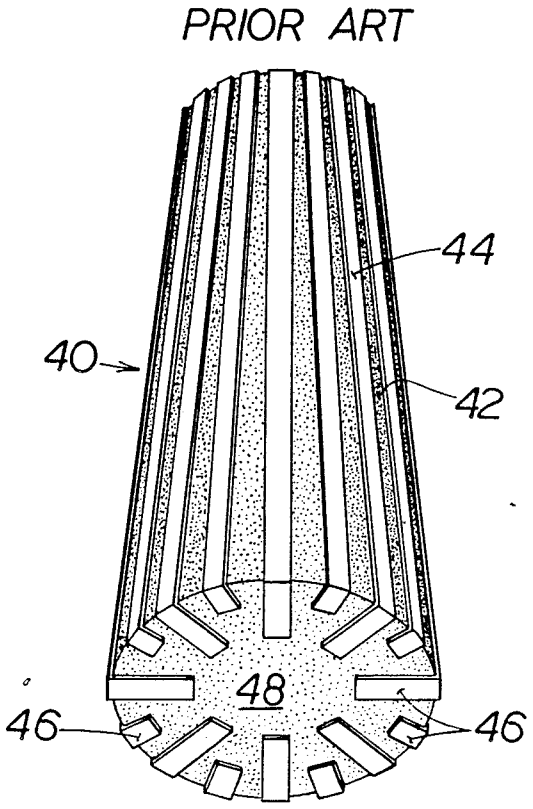
FIG. 7 is a perspective view of a solid refractory plug element heretofore used in the prior art as a component of a device for distributing gas into molten metal within a metallurgical container.

The concept of providing a solid plug in a canister with an array of peripheral passages about the plug and co-defined by the plug's lateral surface and the inside surface of the canister, is a practice known in the art prior to the present invention. FIG. 7 illustrates a solid plug configuration of the type heretofore used in a device for supplying gas through the wall of a metallurgical container. The refractory plug 40 shown in FIG. 7 has a plurality of longitudinally extending surface grooves 42, with adjacent grooves 42 being separated by flat ridges 44. Each flat ridge 44 is continued as a projection 46 across the base end 48 of the plug 40. Assembly of an operational gas distributing device of the type shown in FIG. 7 includes placement of a heated sleeve, such as the sleeve 14, shown in FIG. 1, about the plug 40 and allowing it to cool and firmly lock onto the plug. The projections 46 across the base end 48 serve to space a closure member brought into position to complete the assembly, whereby gas flow passages are formed across the base end 48, between the projections 46 and in communication with the longitudinal passages defined by slots 42.

A problem in the aforedescribed arrangement has been the tendency for the metallic jacket or sleeve to pull inwardly as an incident of its installation on the plug partially dipping into the slots 42, particularly in the area near the base end of the plug 40, thereby forming a slightly corrugated configuration in the sleeve or jacket skin. This undesirable loss of uniformity in the jacket shape tends to partially restrict the available flow area in the longitudinal passages, creates a problem relating to positioning and securely attaching a metal disc or closure member across the base end 48 of the plug 40 and prevents symmetrical registration of the jacket in the socket provided in the ladle inner wall.

Figure 4:
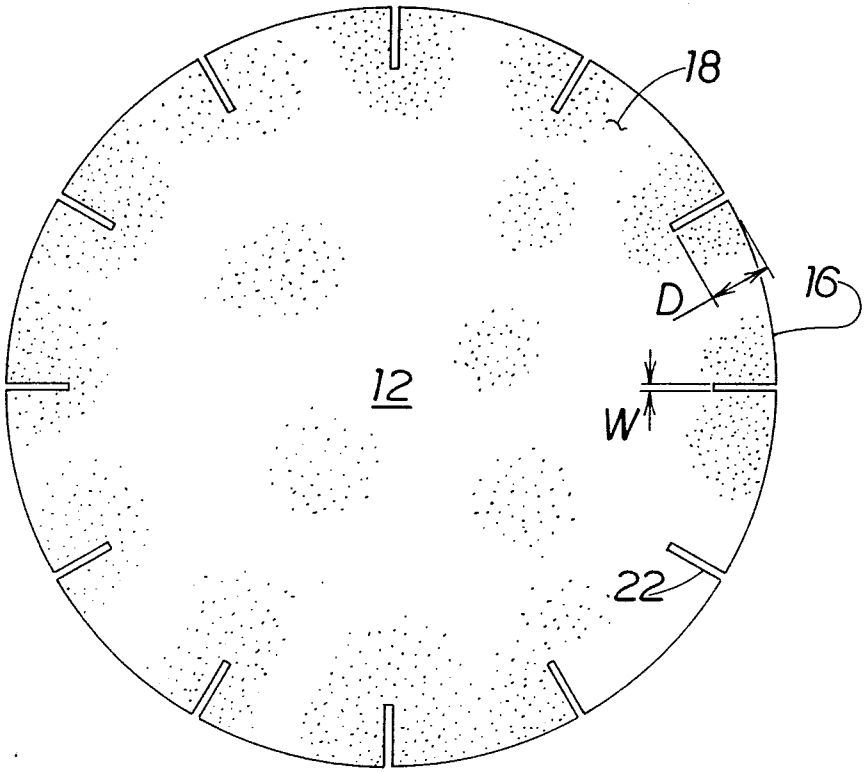
FIG. 4 is a bottom plan view of the plug component in FIG. 2 but, here, shown significantly enlarged.

The provision, in the device 10 of the present invention, of uniform deep narrow slots 22 in the lateral surface of plug 12, as emphasized in the enlarged FIG. 4, is specifically intended to eliminate the problem of undesirable wavy distortion of the surrounding metal sleeve when it is heated and placed in position over the plug and allowed to cool and shrink tightly against the plug body. With respect to each slot 22, it is preferred that the depth "D" exceeds the width by at least ten times and preferably approximately fifteen times. This enables the use of thin guage stainless steel in forming the sleeve while avoiding inward sleeve distortion at the slots. It also assures flow area in the channels formed by the slots is far in excess of normal flow requirements, this for reasons hereinafter explained with specific reference to FIGS. 8, 9, and 10.

The present invention also addresses the problem frequently experienced in the use of prior art devices for supplying gas through the wall of a metallurgical container, namely, the restriction of gas flow through the device caused by molten metal flowing against the face end of the refractory plug and blocking gas distribution.

Figure 10:
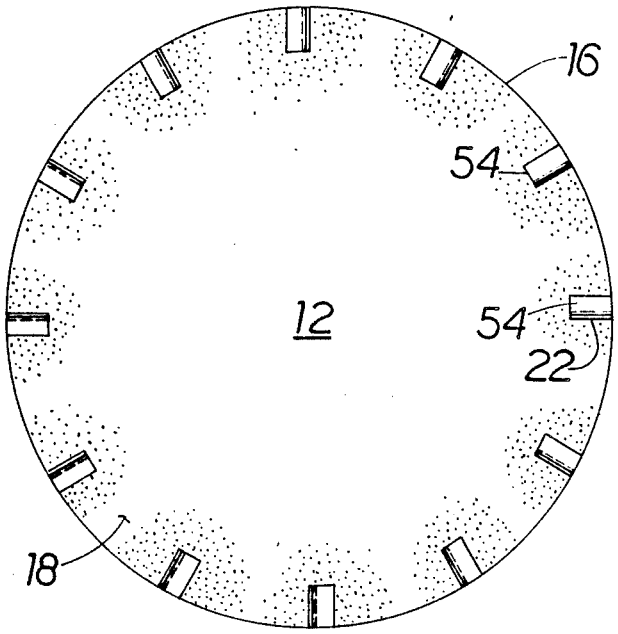
FIG. 10 is an enlarged bottom plan view of the refractory plug element first shown in FIG. 1, but showing operational disposition of a plurality of strip elements as first shown in FIG. 8.
Figure 8:
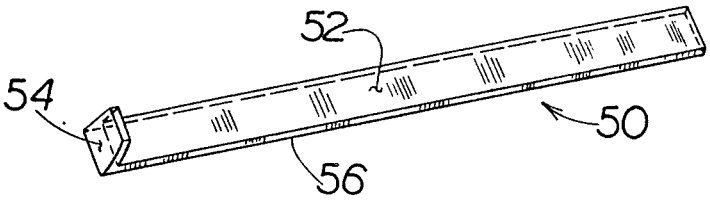
FIG. 8 is a perspective view of a strip element which is a component of the preferred embodiment of the present invention.
Figure 9:
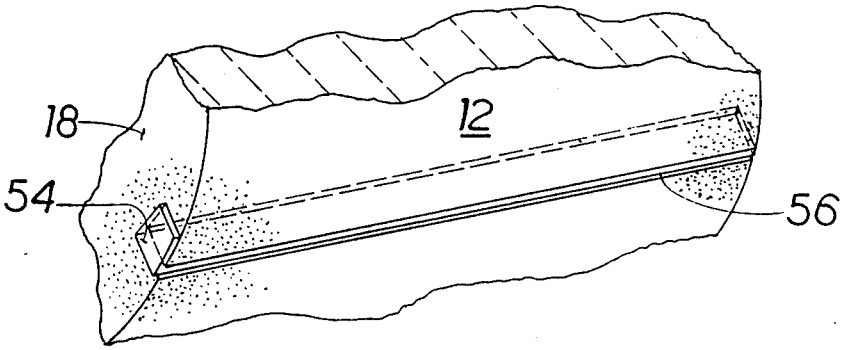
FIG. 9 is a fragmentary perspective view of a portion of the refractory plug first shown in FIG. 1 showing disposition of the strip element first shown in FIG. 8.

In the present invention, a heat sink concept is utilized by the provision of an elongated metal strip, preferably stainless steel, contained within each of the slots 22. FIG. 8 shows a strip 50, constituting a strap-like configuration with a flat elongated body portion 52 having opposite planar surfaces and an integral end tab portion 54 projecting at a right angle to the body portion 52. A strip 50 is placed to extend substantially the full length within each slot 22, as shown in FIG. 9, whereby the end tab 54 rests against the base end 18 of the plug 12. FIG. 10 illustrates the base end 18 of the plug 12, with a strip 50 disposed in each of the slots 22 whereby the respective end tabs 54 overlie the surface of base end 18 of plug 12 in a direction lateral to the opening of the slot 22.

Each strip 50 at least one-third and preferably about one-half the available area within the slot 22, with the width of the strip being such that it extends substantially the full depth "D" of the slot 22 as shown in FIG. 4, and the thickness of the strip being one-half the slot width "W". The presence of the strip 50 with the slot 22 and its full expanse acts to entrain any molten metal droplets which enter the slot 22 at the face end 20 of the plug 12 whereby the immediate heat transfer from the molten metal to the strip promotes solidification of the molten metal.

It is believed that the efforts of a person familiar with the art wishing to practice the invention herein disclosed will be facilitated by the presentation of certain dimensional details applicable to an actual prototype of the device 10 shown in the accompanying drawings. Hence, with reference to a particular prototype heretofore constructed, the plug 12 shown in FIG. 2 has a length from its base end to its face end of 11.29 inches. The diameter of the base end of the plug 12 is 6.12 inches and the diameter of the face end is 4.65 inches. Each of the twelve slots 22 in the plug 12 (see FIG. 4) has a depth "D" of three-eighths of an inch and a width "W" of 0.6 millimeters. For inclusion in the respective slots 22, each strip 50 has a three-eighths inch width and is 0.3 millimeters thick. The length of the body portion 52 of the strip 50 is substantially equal to the length of the plug 12. Although the foregoing specific description is of an actual prototype, some dimensional variations may be utilized without significantly detracting from the operational efficiency of device 10. If so, the thickness of each strip 50 should be constant and within the range of one to three millimeters, with the shortest dimension across each slot 22 being within the range of four to six millimeters.

A gas distribution device of the type herein described, if constructed in the described form, with reasonably close maintenance of the proportional relationship between the dimensions heretofore given with respect to the plug 12 and the strip 50, can be expected to have fewer operational problems due to cooled metal blockage or plug body deterioration, particularly if a high quality dense refractory material is used in the plug formation.

It is anticipated that modifications or variations may hereafter be made which depart from the specific structure illustrated with reference to the preferred embodiment in the accompanying drawings, and it is intended that all such modifications or equivalent variations be included within the scope of the appended claims.

I claim:

1. A device for supplying gas through the wall of a metallurgical container, comprising:

a plug of impervious refractory material closely fitted within, and extending substantially the full length of, a sleeve;

the sleeve having an open outlet end and an opposite substantially closed end;

the plug having a face end adjacent the sleeve's outlet end and a base end adjacent the sleeve's closed end;

conduit means, for conducting a gas flow from the sleeve's closed end and out through the outlet end, including a plurality of spaced-apart passages extending from inwardly adjacent the closed end to the outlet end, each of the passages being a slot in the plug and being partially defined along its full length by the inside surface of the sleeve; and the passages containing metallic elongated strip having a first end terminating at a point closely adjacent the outlet end of the sleeve, the strip having a flat strap-like configuration with opposite planar surfaces and narrow longitudinal edges, and one of the edges oriented directly toward the sleeve's inside surface.

2. The device of claim 1 wherein the second end of the strip extends out of the passage and is angled across the base end of the plug.

3. The device of claim 1 wherein the plug has the shape of a truncated cone, with the slots formed in its lateral surface and extending from its base end to its face end, each of the slots being substantially rectilinear and uniform in cross-section and of a depth at least ten times greater than the width.

4. The device of claim 1 wherein each of the passages contains a strip.

5. The device of claim 1 further including a block of refractory material defining a central socket, and the sleeve being concentrically positioned within the socket.

6. The device of claim 5 wherein the sleeve is a stainless steel canister.

7. The device of claim 6 further including a refractory block disposed about the canister.

8. The device of claim 1 wherein the sleeve has a planar closure member across its base end, and the closure member is in spaced relation to the plug to thereby form a manifold chamber defined between the closure member and the plug.

9. The device of claim 8 further comprising means for conducting a gas flow into the manifold chamber.

10. The device of claim 1 wherein the strip is stainless steel.

11. The device of claim 1 wherein the strip has a constant thickness within the range of one to three millimeters, and the shortest dimension across the slot is within the range of four to six millimeters.

12. A device for supplying gas through the wall of a metallurgical container comprising:

a refractory plug having a frusto-conical configuration presenting a narrow face end, an opposite base end, and a lateral peripheral sidewall surface;

a canister surrounding and contiguous to the plug's sidewall surface;

a substantially narrow straight channel in the plug's sidewall surface, extending from the plug's face end to its base end and partially defined by the inside surface of the canister;

the channel having a width dimension taken generally transverse to the plug radius and a depth dimension taken generally coextensive with the plug radius, and the depth dimension being at least ten times the width dimension.

13. The device of claim 12 having a plurality of the channels equidistantly spaced about the plug.

14. The device of claim 12 further comprising a closure member disposed across the end of the canister in spaced adjacency to the base end of the plug.

15. The device of claim 12 further comprising an elongated metal strip extending within the channel.

16. The device of claim 12 wherein the strip occupies at least one-third of the space in the channel.

17. The device of claim 12 further comprising means at the base end of the plug for conducting a flow of gas into the channel.

18. The device of claim 12 wherein the canister is stainless steel.

19. The device of claim 12 wherein the strip is stainless steel.

* * * * *